US008836623B2

(12) United States Patent
Li et al.

(10) Patent No.: US 8,836,623 B2
(45) Date of Patent: Sep. 16, 2014

(54) ESD PROTECTION DEVICE OF LCD DISPLAY

(75) Inventors: Chihhsien Li, Shenzhen (CN); Jehao Hsu, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 315 days.

(21) Appl. No.: 13/380,877

(22) PCT Filed: Sep. 28, 2011

(86) PCT No.: PCT/CN2011/080320

§ 371 (c)(1),
(2), (4) Date: May 8, 2012

(87) PCT Pub. No.: WO2012/171282

PCT Pub. Date: Dec. 20, 2012

(65) Prior Publication Data

US 2012/0319932 A1 Dec. 20, 2012

(51) Int. Cl.
*G09G 3/36* (2006.01)

(52) U.S. Cl.
CPC ..... *G09G 3/36* (2013.01); *G09G 2330/04* (2013.01); *G09G 3/3685* (2013.01); *G09G 2300/043* (2013.01); *G09G 3/3674* (2013.01)
USPC ..... 345/87

(58) Field of Classification Search
USPC ..... 345/76, 87; 349/139
See application file for complete search history.

(56) References Cited

U.S. PATENT DOCUMENTS

| | | | | |
|---|---|---|---|---|
| 7,750,408 | B2 * | 7/2010 | He et al. | 257/355 |
| 2005/0093796 | A1 * | 5/2005 | Fergason | 345/88 |
| 2005/0184344 | A1 * | 8/2005 | Ker et al. | 257/360 |
| 2006/0151851 | A1 * | 7/2006 | Pillai et al. | 257/531 |
| 2006/0152470 | A1 * | 7/2006 | Kim | 345/102 |
| 2006/0268187 | A1 * | 11/2006 | Kim et al. | 349/40 |
| 2008/0043162 | A1 * | 2/2008 | Tung et al. | 349/40 |
| 2008/0088758 | A1 * | 4/2008 | Shie | 349/40 |
| 2008/0180418 | A1 * | 7/2008 | Fu | 345/204 |
| 2009/0135122 | A1 * | 5/2009 | Jeoung et al. | 345/92 |

FOREIGN PATENT DOCUMENTS

WO WO 2012/171282 A1 * 12/2012

* cited by examiner

*Primary Examiner* — Joe H Cheng

(57) ABSTRACT

The present invention discloses an ESD protection device of an LCD display. The LCD display includes a plurality of scan lines and a plurality of data lines, the scan lines and the data lines are crossed. The ESD protection device includes a discharging extension part, positioned at ends of the scan lines and the data lines, wherein a width of the discharging extension part is larger than line widths of the scan lines or the data lines; and an electro-static conducting part, positioned in peripheral of the discharging extension part, wherein the electro-static conducting part is close to the discharging extension part without touching the discharging extension part, and the electro-static conducting part is coupled to a common conducting layer to release electro-static charges on the scan lines and data lines via the common conducting layer. The present invention can enormously reduce the ESD damages on the pixel areas.

14 Claims, 5 Drawing Sheets

ESD PROTECTION DEVICE OF LCD DISPLAY

BACKGROUND OF THE INVENTION

1. Field of the Invention

The invention relates to an LCD display, and more particularly, to an electro-static discharge (ESD) protection device of an LCD display.

2. Description of the Prior Art

LCD displays are widely used in modern electronic devices such as computers, mobile phones, and PDAs because they are thin, light, and low power consuming. A conventional LCD display mainly comprises an LCD panel and a backlight module. And the LCD panel mainly comprises a matrix substrate, a color filter substrate, and a liquid crystal layer disposed therebetween, wherein the matrix substrate comprises pixel areas defined by the pixel matrix.

Normally, the matrix substrate may have electro-static charges when the matrix substrate is being manufactured. When the electro-static charges are accumulated to a threshold, an electro-static discharge (ESD) phenomenon occurs such that the pixel areas are damaged.

In the case that the size of the matrix substrate is small, the accumulated electro-static charges are comparatively small. Therefore, the possibility of the above-mentioned ESD damage is small or ignorable. But, if the size of the matrix substrate is big, the ESD damage becomes more severe. Therefore, ESD protection for preventing from the ESD damage is more essential in that case.

Please refer to FIG. 1. As shown in FIG. 1, in the related art, a commonly-used ESD protection is to design the ends of the scan lines 101 and data lines 102 as sharp ends, and to position short lines 103 corresponding to the sharp ends in the peripheral areas of the pixel areas. In this way, if the electro-static charges are accumulated, the electro-static charges can be released from the sharp ends of the scan lines 101 and the data lines 102 to the short line 103. This can prevent the matrix substrate from accumulating too many electro-static charges and prevent the pixel areas of the substrate from being damaged by the electro-static charges.

However, due to the increase of the size of the matrix substrate, the electro-static charges may by enormously accumulated in a very short time. Unfortunately, in the related art, the above-mentioned method of sharpening the ends of the data lines and scan lines (called "single point" mechanism) is not enough to instantly release the enormously-accumulated electro-static charges. Furthermore, it cannot endure a high electro-static current to flow through.

From the above, it can be seen that the related art cannot efficiently and instantly release the instantly-accumulated electro-static charges such that the pixel areas of the matrix substrate is damaged due to the ESD problems.

SUMMARY OF THE INVENTION

It is therefore one of the primary objectives of the claimed invention to provide an ESD protection device, to efficiently reduce the ESD damage of the pixel areas, in order to solve the above-mentioned problem.

According to an exemplary embodiment of the claimed invention, an ESD protection device of an LCD display is disclosed. The LCD display comprises a plurality of scan lines and a plurality of data lines, where the scan lines and the data lines are crossed. The ESD protection device comprises: a round conductor, positioned at ends of the scan lines and the data lines, wherein a diameter of the round conductor is larger than line widths of the scan lines or the data lines; and a notch, positioned in peripheral of the round conductor, wherein the notch is close to the round conductor without touching the round conductor, and the notch is coupled to a common conducting layer to release electro-static charges on the scan lines and data lines via the common conducting layer.

According to an exemplary embodiment of the claimed invention, an electro-static discharge (ESD) protection device of an LCD display is disclosed. The LCD display comprises a plurality of scan lines and a plurality of data lines, where the scan lines and the data lines are crossed. The ESD protection device comprises: a discharging extension part, positioned at ends of the scan lines and the data lines, wherein a width of the discharging extension part is larger than line widths of the scan lines or the data lines; and an electro-static conducting part, positioned in peripheral of the discharging extension part, wherein the electro-static conducting part is close to the discharging extension part without touching the discharging extension part, and the electro-static conducting part is coupled to a common conducting layer to release electro-static charges on the scan lines and data lines via the common conducting layer.

Or, the discharging extension part is a polygon conductor having a width larger than the line width of the data lines and the scan lines, and the electro-static conducting part is a notch allowing the polygon conductor to closely place inside without touching the notch.

Or, the discharging extension part is a round conductor having a diameter larger than the line width of the data lines and the scan lines, and the round conductor comprises a plurality of protruded thorns on outer of the round conductor, wherein an length of the protruded thorns is much smaller than the diameter.

Or, the discharging extension part is a polygon conductor having a width larger than the line width of the data lines and the scan lines, and the polygon conductor comprises a plurality of protruded thorns on the outer of the polygon conductor, wherein an length of the protruded thorns is much smaller than the width of the polygon conductor.

Or, the discharging extension part is a round conductor having a diameter larger than the line width of the data lines and the scan lines, and the round conductor comprises a plurality of protruded thorns on outer of the round conductor, wherein an length of the protruded thorns is much smaller than the diameter.

Or, the discharging extension part is a polygon conductor having a width larger than the line width of the data lines and the scan lines, and the polygon conductor comprises a plurality of protruded thorns on the outer of the polygon conductor, wherein lengths of the protruded thorns is much smaller than the width of the polygon conductor.

Furthermore, the electro-static conducting part is a notch allowing the discharging extension part to closely place inside without touching the notch, where the notch comprises one or multiple protruded parts on the inner of notch.

Moreover, the electro-static conducting part is a conductor comprising one or a plurality of notches allowing the discharging extension part to closely place inside without touching the notch, wherein the conductor is coupled to a metal common electrode to release the electro-static charges.

In addition, the common conducting layer is a big metal layer surrounding a chip.

In contrast to the related art, the present invention has several advantages. Because the present invention positions the discharging extension part on the ends of the data lines and the scan lines and the electro-static conducting part surrounding the discharging extension part without touch it, the present invention can improve the discharging ability at the ends of the data lines and scan lines. In addition, the present invention provides multiple points to release the electro-static currents and a high electro-static current is allowed to flow through. This ensures that the electro-static current can be released from the pixel areas such that the metal lines located in the pixel areas can be protected from being damaged by the high electro-static current. Therefore, this can raise the yield of products.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Normally, the metal lines (such as data lines and scan lines) located inside the active area of the LCD panel are more probably damaged by the electro-static discharging currents than those located outside the active area.

Figure 1:
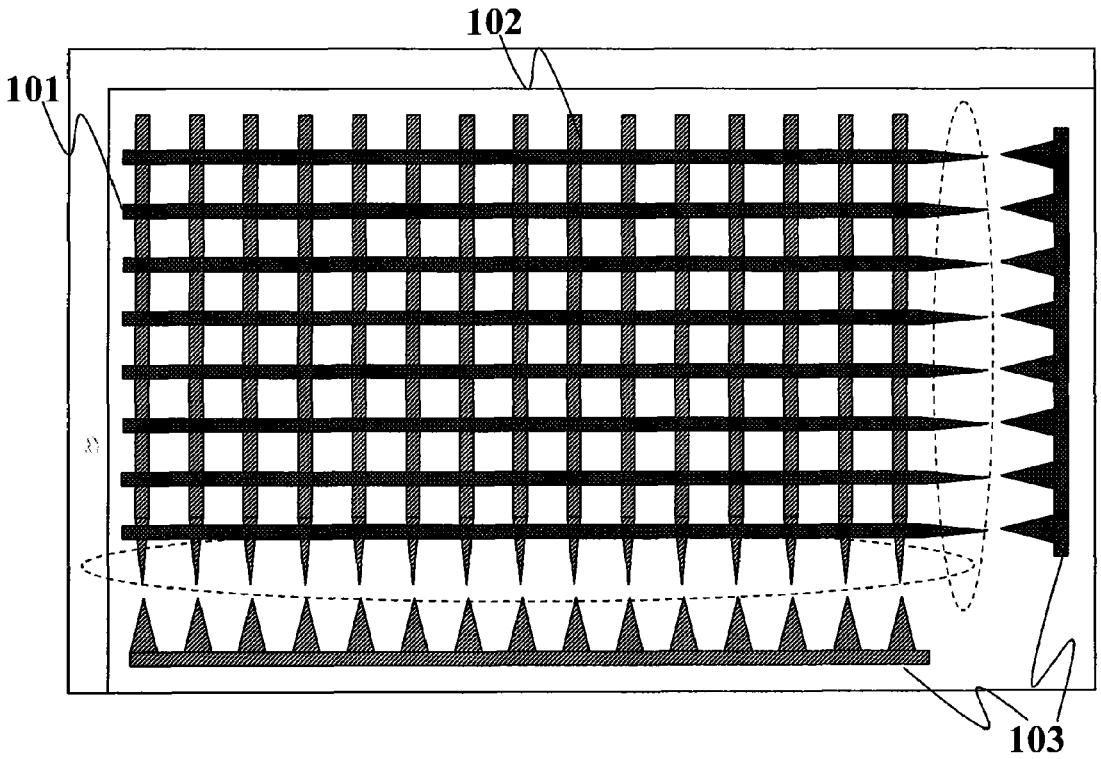
Fig. 1 (Related art)
FIG. 1 is a diagram of an ESD protection device according to the related art.
Figure 2:
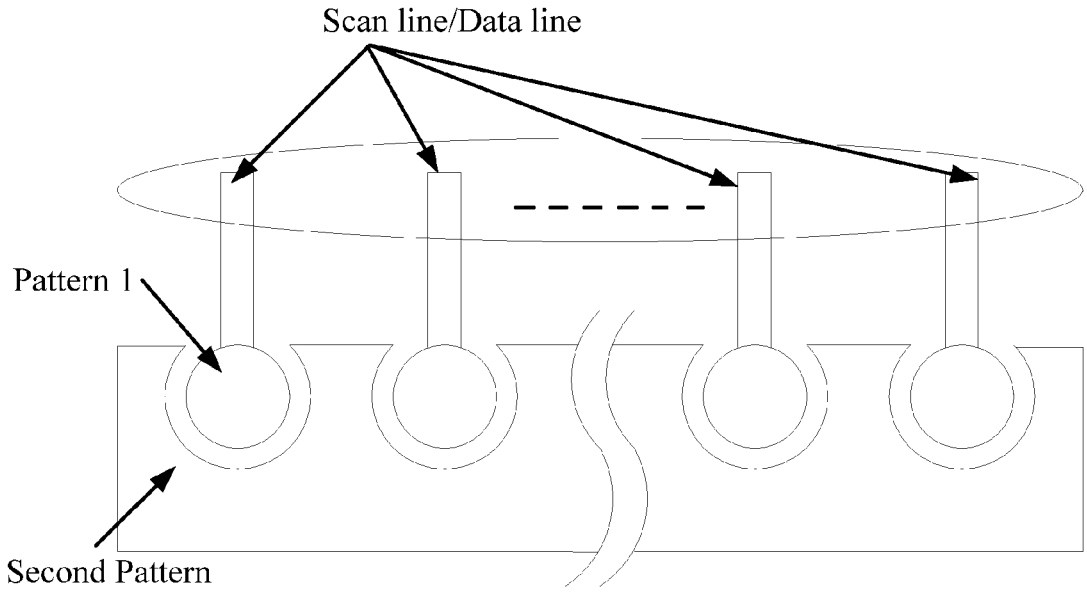
FIG. 2 is a diagram of an ESD protection device of an LCD display according to a first embodiment of the present invention.

Please refer to FIG. 2, which is a diagram of an ESD protection device of an LCD display according to a first embodiment of the present invention. In this embodiment, the present invention positions a discharging extension part on the end of each of the data lines and scan lines, wherein the discharging extension part has a width larger than the line width of the data line or the scan line. For example, in FIG. 2, the discharging extension part is designed as the first pattern. Meanwhile, the present invention further positions an electro-static conducting part in the peripheral of the discharging extension part, the electro-static conducting part is very close to the discharging extension part without touching the discharging extension part. For example, in FIG. 2, the electro-static conducting part is designed as the second pattern. Furthermore, the electro-static conducting part is coupled to the common conducting metal layer located in the peripheral of the electro-static conducting part, such that the electro-static charges can be released via multiple points between the electro-static conducting part and the discharging extension part. Please note, the designer can properly decide the distance between the electro-static conducting part and the discharging extension part according to the actual conditions (such as the magnitude of the electro-static charges and the conductivity of the materials) to achieve the aforementioned multi-point discharging mechanism. This can raise the discharging efficiency and endure a higher electro-static current.

Please note, the first pattern can be replaced by other shapes of patterns as long as the width of the first pattern is larger than the line width of the scan lines and data lines. For example, the first pattern can be ellipse, square, polygon.

Figure 3:
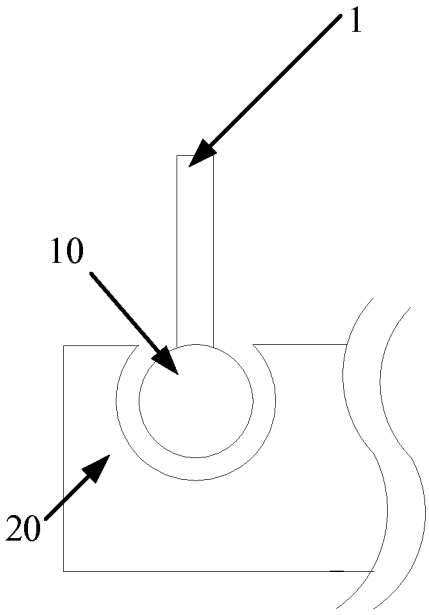
FIG. 3 is a diagram showing a unit of the ESD protection device shown in FIG. 2.

Please refer to FIG. 3, which is a diagram of a unit of the ESD protection device shown in FIG. 2. The LCD display (not shown) comprises a plurality of data lines and a plurality of scan lines 1, the data lines and the scan lines 1 are crossed. As shown in FIG. 3, a discharging extension part 10 is positioned at the ends of the data lines and scan lines 1, the width of the discharging extension part 10 is larger than the line width of the data lines and the scan lines 1. Moreover, the electro-static conducting part 20 is positioned in the peripheral of the discharging extension part 10, and the electro-static conducting part 20 is very close to the discharging extension part 10 without touching it. In addition, the electro-static conducting part 20 is coupled to the common conducting metal layer to release the electro-static charges on the data lines and scan lines 1. Furthermore, the above-mentioned common conducting metal layer is a big metal layer surrounding a chip.

The unit shown in FIG. 3 can be regarded as a basic element of the ESD protection device. That is, the unit can be repeatedly placed to form the complete ESD protection device.

Please note, the above-mentioned shapes and the positions of the discharging extension part 10 and the electro-static conducting part 20 are only regarded as an embodiment, not a limitation of the present invention. In the actual implementation, their shapes and positions can be changed as long as they meet the requirement of increasing the discharging points and the endurance of the electro-static current. Meanwhile, the distance between the discharging extension part 10 and the electro-static conducting part 20 can be designed as a proper value as long as the electro-static current can be released successfully.

For example, the discharging extension part 10 can be a round or ellipse conductor whose width is larger than the width of the data lines and scan lines 1. And the electro-static conducting part 20 can be a notch allowing the round or ellipse conductor to closely place inside without touching the notch.

Surely, the discharging extension part 10 can be a polygon conductor whose width is larger than the width of the data lines and scan lines 1. And the electro-static conducting part 20 can be a notch allowing the polygon conductor to closely place inside without touching the notch.

Furthermore, in a certain LCD display, the shapes and the sizes of the discharging extension parts 10 are not required to be the same. Because some places inside the LCD display may need a higher electro-static discharging ability, they can be appropriately adjusted. Surely, the shapes and the sizes of the electro-static conducting parts 20 are correspondingly adjusted according to the corresponding discharging extension parts 10.

Figure 4:
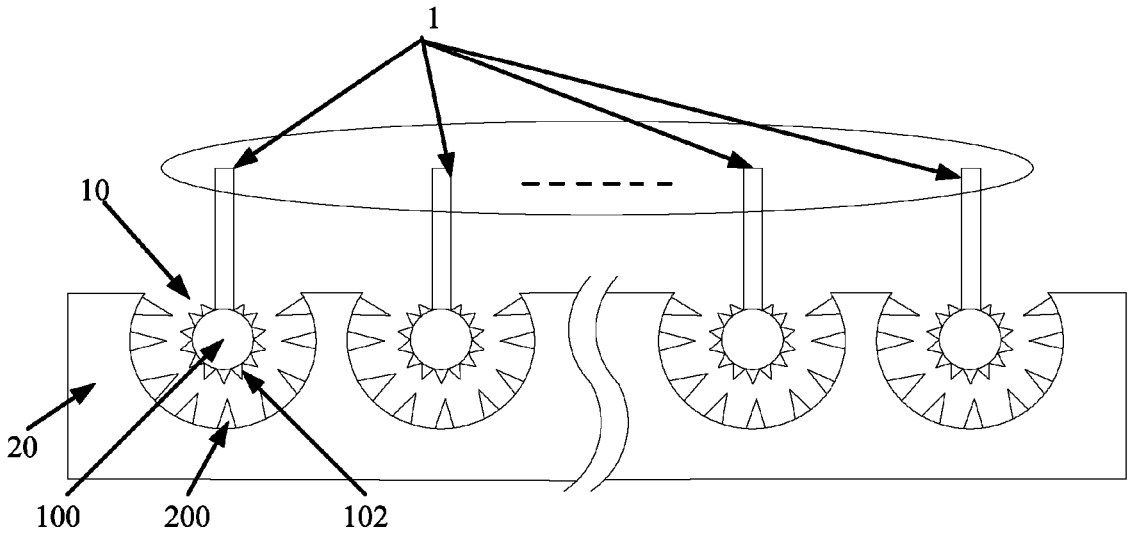
FIG. 4 is a diagram of an ESD protection device of an LCD display according to a second embodiment of the present invention.

Please refer to FIG. 4, which is a diagram of an ESD protection device of an LCD display according to a second embodiment of the present invention. In order to further raise the electro-static discharging ability, the discharging extension part 10 can comprise a main body 100 and multiple protruded thorns 102 around the main body 100. The main body 100 is a round conductor having a diameter larger than the line widths of the data lines and scan lines 1. And multiple protruded thorns 102 are positioned on the outer of the round conductor, where the length of the protruded thorns is much shorter than the diameter of the round conductor.

Please note, the main body 100 of the discharging extension part 10 can also by the polygon conductor having a width larger than the line width of the data lines and the scan lines, and multiple protruded thorns 102 are positioned on the outer of the polygon conductor, where the length of the protruded thorns is much shorter than the width of the polygon conductor.

Correspondingly, the electro-static conducting parts 20 can be a notch allowing the discharging extension part 10 to closely place inside without touching the notch, and the notch can comprise one or multiple protruded parts 200 on the inner of notch.

Figure 5:
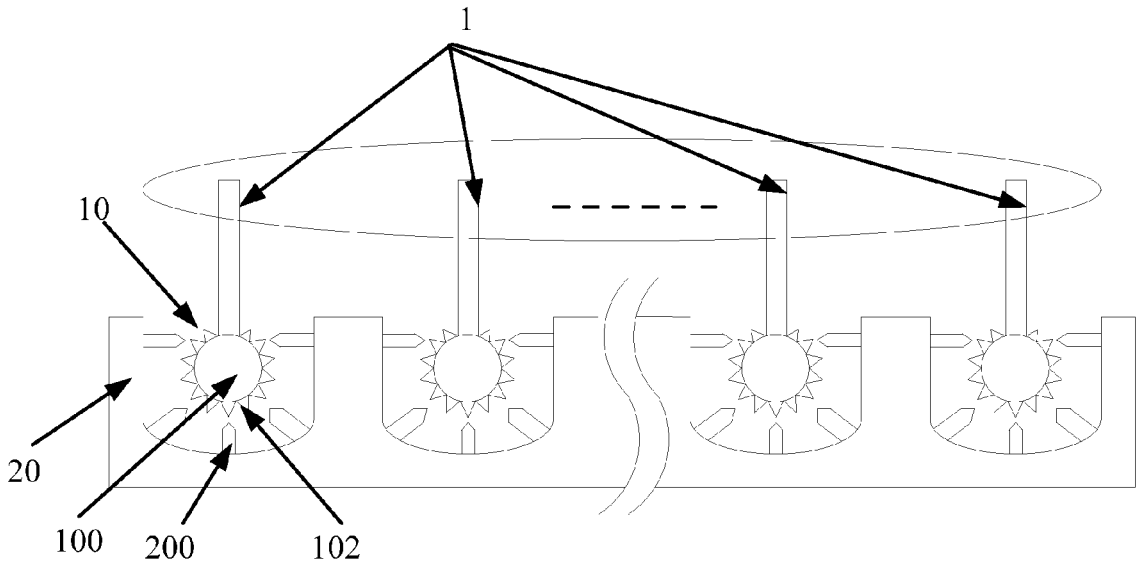
FIG. 5 is a diagram of an ESD protection device of an LCD display according to a third embodiment of the present invention.

Please refer to FIG. 5, which is a diagram of an ESD protection device of an LCD display according to a third embodiment of the present invention. Please note, the sizes and number of the protruded thorns 102 surrounding on the main body 100 is not certainly matched to the sizes and numbers of the protruded parts 200 on the inner of the electro-static conducting parts 20. In a preferred embodiment, the protruded thorns 102 of the discharging extension part 10 are small and dense, the protruded parts 200 of the electro-static conducting parts 20 are correspondingly bigger and sparse.

Furthermore, the electro-static conducting part 20 is a conductor comprising one or a plurality of notches allowing the conductor to closely place inside without touching the notch, where the conductor is coupled to a metal common electrode to release the electro-static charges.

Please note, in the above-mentioned embodiments, the data lines/scan lines and the discharging extension part 10 can be manufactured by the same material or different materials, the main body 100 and protruded thorns 102 can be manufactured by the same material or different materials, and the protruded parts 200 and the other part of the electro-static conducting parts 20 can be manufactured by the same material or different materials. There are no limitations in the present invention.

In addition, the data lines/scan lines and the discharging extension part 10 can be manufactured by Integrally molding or separately, the main body 100 and protruded thorns 102 can be manufactured by Integrally molding or separately, and the protruded parts 200 and the other part of the electro-static conducting parts 20 can be manufactured by Integrally molding or separately. There are no limitations in the present invention, either.

Furthermore, the materials of the data lines/scan lines, the discharging extension part 10, and the electro-static conducting parts 20 can be different.

In contrast to the related art, the present invention has several advantages. Because the present invention positions the discharging extension part on the ends of the data lines and the scan lines and the electro-static conducting part surrounding the discharging extension part without touch it, the present invention can improve the discharging ability at the ends of the data lines and scan lines. In addition, the present invention provides multiple points to release the electro-static currents and a high electro-static current is allowed to flow through. This ensures that the electro-static current can be released from the pixel areas such that the metal lines located in the pixel areas can be protected from being damaged by the high electro-static current. Therefore, this can raise the yield of products.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An electro-static discharge (ESD) protection device of an LCD display, the LCD display comprising a plurality of scan lines and a plurality of data lines, the scan lines and the data lines are crossed, characterized in that:

a discharging extension part, positioned at ends of the scan lines and the data lines, wherein a width of the discharging extension part is larger than line widths of the scan lines or the data lines; and an electro-static conducting part, positioned in peripheral of the discharging extension part, wherein the electro-static conducting part is close to the discharging extension part without touching the discharging extension part, and the electro-static conducting part is coupled to a common conducting layer to release electro-static charges on the scan lines and data lines via the common conducting layer.

2. The ESD protection device of claim 1, characterized in that:

the discharging extension part is a round conductor having a diameter larger than the line width of the data lines and the scan lines, and the electro-static conducting part is a notch allowing the round conductor to closely place inside without touching the notch.

3. The ESD protection device of claim 1, characterized in that:

the discharging extension part is an elliptical conductor having a diameter larger than the line width of the data lines and the scan lines, and the electro-static conducting part is a notch allowing the elliptical conductor to closely place inside without touching the notch.

4. The ESD protection device of claim 1, characterized in that:

the discharging extension part is a polygon conductor having a width larger than the line width of the data lines and the scan lines, and the electro-static conducting part is a notch allowing the polygon conductor to closely place inside without touching the notch.

5. The ESD protection device of claim 1, characterized in that:

the discharging extension part is a round conductor having a diameter larger than the line width of the data lines and the scan lines, and the round conductor comprises a plurality of protruded thorns on outer of the round conductor, wherein an length of the protruded thorns is much smaller than the diameter.

6. The ESD protection device of claim 1, characterized in that:

the discharging extension part is a polygon conductor having a width larger than the line width of the data lines and the scan lines, and the polygon conductor comprises a plurality of protruded thorns on the outer of the polygon conductor, wherein lengths of the protruded thorns is much smaller than the width of the polygon conductor.

7. The ESD protection device of claim 1, 2, 3, 4, 5 or 6, characterized in that:

the electro-static conducting part is a notch allowing the discharging extension part to closely place inside without touching the notch, wherein the notch comprises one or multiple protruded parts on the inner of notch.

8. The ESD protection device of claim 1, 2, 3, 4, 5 or 6, characterized in that:

the electro-static conducting part is a conductor comprising one or a plurality of notches allowing the discharging extension part to closely place inside without touching the notch, wherein the conductor is coupled to a metal common electrode to release the electro-static charges.

9. The ESD protection device of claim 1, 2, 3, 4, 5 or 6, characterized in that:

the common conducting layer is a big metal layer surrounding a chip.

10. An ESD protection device of an LCD display, the LCD display comprising a plurality of scan lines and a plurality of data lines, the scan lines and the data lines are crossed, characterized in that:

a round conductor, positioned at ends of the scan lines and the data lines, wherein a diameter of the round conductor is larger than line widths of the scan lines or the data lines; and a notch, positioned in peripheral of the round conductor, wherein the notch is close to the round conductor without touching the round conductor, and the notch is coupled to a common conducting layer to release electro-static charges on the scan lines and data lines via the common conducting layer.

11. The ESD protection device of claim 10, characterized in that:

the round conductor comprises a plurality of protruded thorns on outer of the round conductor, wherein an length of the protruded thorns is much smaller than the diameter.

12. The ESD protection device of claim 11, characterized in that:

the notch comprises one or multiple protruded parts on the inner of the notch.

13. The ESD protection device of claim 12, characterized in that:

the notch is coupled to a metal common electrode to release the electro-static charges.

14. The ESD protection device of claim 13, characterized in that:

the common conducting layer is a big metal layer surrounding a chip.

* * * * *